US009702202B2

(12) United States Patent
Surjaatmadja et al.

(10) Patent No.: US 9,702,202 B2
(45) Date of Patent: Jul. 11, 2017

(54) METHODS AND SYSTEMS FOR CONTROLLING TORQUE TRANSFER FROM ROTATING EQUIPMENT

(71) Applicant: Halliburton Energy Services, Inc., Houston, TX (US)

(72) Inventors: Jim B. Surjaatmadja, Duncan, OK (US); Loyd East, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 494 days.

(21) Appl. No.: 14/327,020

(22) Filed: Jul. 9, 2014

(65) Prior Publication Data

US 2014/0318869 A1 Oct. 30, 2014

Related U.S. Application Data

(60) Division of application No. 13/790,270, filed on Mar. 8, 2013, now Pat. No. 8,807,243, which is a (Continued)

(51) Int. Cl.

| | |
|---|---|
| ***E21B 17/10*** | (2006.01) |
| ***E21B 4/18*** | (2006.01) |
| ***E21B 47/00*** | (2012.01) |

(52) U.S. Cl.

CPC ..... *E21B 17/1014* (2013.01); *E21B 4/18* (2013.01); *E21B 17/1057* (2013.01); *E21B 17/1078* (2013.01); *E21B 47/0006* (2013.01)

(58) Field of Classification Search

CPC .... E21B 4/18; E21B 17/1057; E21B 17/1078; E21B 17/1014

See application file for complete search history.

(56) References Cited

U.S. PATENT DOCUMENTS 512,736 A 1/1894 McGovern
1,406,350 A * 2/1922 Corrigan ..... E21B 4/18 166/206

(Continued)

FOREIGN PATENT DOCUMENTS

| | | | |
|---|---|---|---|
| CN | 1267353 | A | 9/2000 |
| CN | 101463712 | A | 6/2009 |
| CN | 101680280 | A | 3/2010 |

OTHER PUBLICATIONS

Office Action issued in Chinese Application No. 201180072896.9 on Feb. 2, 2015.

(Continued)

*Primary Examiner* — Blake Michener

(74) *Attorney, Agent, or Firm* — Alan Bryson; Baker Botts L.L.P.

(57) ABSTRACT

Systems and methods for reducing the amount of torque transferred to the Bottom Hole Assembly and the drill string during drilling operations are disclosed. The drill string includes an optionally non-rotatable portion. A rotational hold down system is positioned at a first position on the drill string where it is not rotationally coupled to the drill string. The rotational hold down system is then moved to a second position on the drill string where it is rotationally coupled to the optionally non-rotatable portion of the drill string. In the second position, one or more bars on the rotational hold down system substantially prevent rotation of the optionally non-rotatable portion of the drill string.

4 Claims, 14 Drawing Sheets

Related U.S. Application Data continuation of application No. PCT/US2011/043975, filed on Jul. 14, 2011.

(56) References Cited

U.S. PATENT DOCUMENTS

| | | | | |
|---|---|---|---|---|
| 1,450,804 | A | 4/1923 | Gross | |
| 1,870,697 | A * | 8/1932 | Taylor | E21B 4/18 166/212 |
| 2,643,087 | A * | 6/1953 | Ogorzaly | E21B 4/04 166/165 |
| 2,712,920 | A | 7/1955 | Cullen et al. | |
| 2,892,524 | A | 6/1959 | Sinclair | |
| 3,476,196 | A * | 11/1969 | Whittle | E21B 17/1014 175/273 |
| 3,935,934 | A | 2/1976 | Norberg | |
| 4,512,422 | A | 4/1985 | Knisley | |
| 4,612,987 | A | 9/1986 | Cheek | |
| 4,679,636 | A | 7/1987 | Ruhle | |
| 6,227,313 | B1 | 5/2001 | Davis et al. | |
| 6,340,063 | B1 | 1/2002 | Comeau et al. | |
| 6,378,627 | B1 * | 4/2002 | Tubel | E21B 4/18 166/250.01 |
| 7,735,581 | B2 | 6/2010 | Beylotte et al. | |
| 8,191,639 | B2 | 6/2012 | Howlett et al. | |
| 9,121,239 | B2 * | 9/2015 | Schulte | E21B 23/01 |
| 9,399,894 | B2 * | 7/2016 | Perry | E21B 17/1014 |
| 2002/0032126 | A1 * | 3/2002 | Kusmer | E21B 4/18 507/100 |
| 2002/0104686 | A1 * | 8/2002 | Bloom | E21B 4/18 175/99 |
| 2002/0166701 | A1 | 11/2002 | Comeau et al. | |
| 2003/0034177 | A1 | 2/2003 | Chitwood et al. | |
| 2003/0196818 | A1 * | 10/2003 | Lynde | E21B 4/18 166/382 |
| 2004/0168831 | A1 | 9/2004 | Nozaki et al. | |
| 2005/0145415 | A1 * | 7/2005 | Doering | E21B 4/18 175/24 |
| 2005/0150694 | A1 * | 7/2005 | Schuh | E21B 17/1057 175/325.1 |
| 2007/0209806 | A1 * | 9/2007 | Mock | E21B 4/18 166/382 |
| 2008/0236841 | A1 | 10/2008 | Howlett et al. | |
| 2009/0159269 | A1 * | 6/2009 | Sheiretov | E21B 4/18 166/216 |
| 2009/0255676 | A1 * | 10/2009 | Peters | E21B 4/18 166/298 |
| 2010/0175888 | A1 * | 7/2010 | Buytaert | E21B 17/00 166/373 |
| 2010/0243274 | A1 * | 9/2010 | Guerrero | E21B 4/18 166/382 |

OTHER PUBLICATIONS

International Preliminary Report on Patentability issued in related International Application No. PCT/US2011/043975, mailed Jan. 23, 2014, 9 pages.

International Search Report and Written Opinion issued in related International Application No. PCT/US2011/043975, mailed Apr. 11, 2012, 11 pages.

* cited by examiner

METHODS AND SYSTEMS FOR CONTROLLING TORQUE TRANSFER FROM ROTATING EQUIPMENT

PRIORITY

The present application is a divisional application of U.S. patent application Ser. No. 13/790,270 which was filed Mar. 8, 2013 which was a continuation application of International (PCT) Application No. PCT/US2011/043975 which was filed on Jul. 14, 2011 and the entirety of which is incorporated by reference herein.

BACKGROUND

To produce hydrocarbons (e.g., oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing a casing or liner into place. Once the wellbore is completed as desired (lined, cased, open hole, or any other known completion), a stimulation operation may be performed to enhance hydrocarbon production into the wellbore. Examples of some common stimulation operations involve hydraulic fracturing, acidizing, fracture acidizing, and hydrajetting. Stimulation operations are intended to increase the flow of hydrocarbons from the subterranean formation surrounding the wellbore into the wellbore itself so that the hydrocarbons may then be produced up to the wellhead.

In traditional systems for drilling boreholes, rock destruction is carried out via rotary power conveyed by rotating the drill string at the surface using a rotary table or by rotary power derived from mud flow downhole using, for example, a mud motor. Through these modes of power provision, traditional bits such as tri-cone, polycrystalline diamond compact ("PDC"), and diamond bits are operated at speeds and torques supplied at the surface rotary table or by the downhole motor.

When using a down hole motor, such as a mud motor, to generate the torque for performing drilling operations, some of the torque generated during the drilling operations may be transferred to the drilling string instead of the drill bit. This unwanted torque transfer renders the drill string unstable. Moreover, it reduces the torque that is delivered to the drill bit, reducing the efficiency of the drilling operations. It is therefore desirable to minimize the torque transferred to the Bottom Hole Assembly ("BHA"), the drill string and coil tubing.

BRIEF DESCRIPTION OF THE DRAWINGS

Some specific example embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples," as used herein are intended to mean either an indirect or direct connection. Thus, if a first device couples to a second device, that connection may be through a direct connection, or through an indirect electrical connection via other devices and connections. The term "uphole" as used herein means along the drill string or the hole from the distal end towards the surface, and "downhole" as used herein means along the drill string or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

The present invention relates generally to well drilling and completion operations and, more particularly, to systems and methods for reducing the amount of torque transferred to the Bottom Hole Assembly and the drill string.

Figure 1:
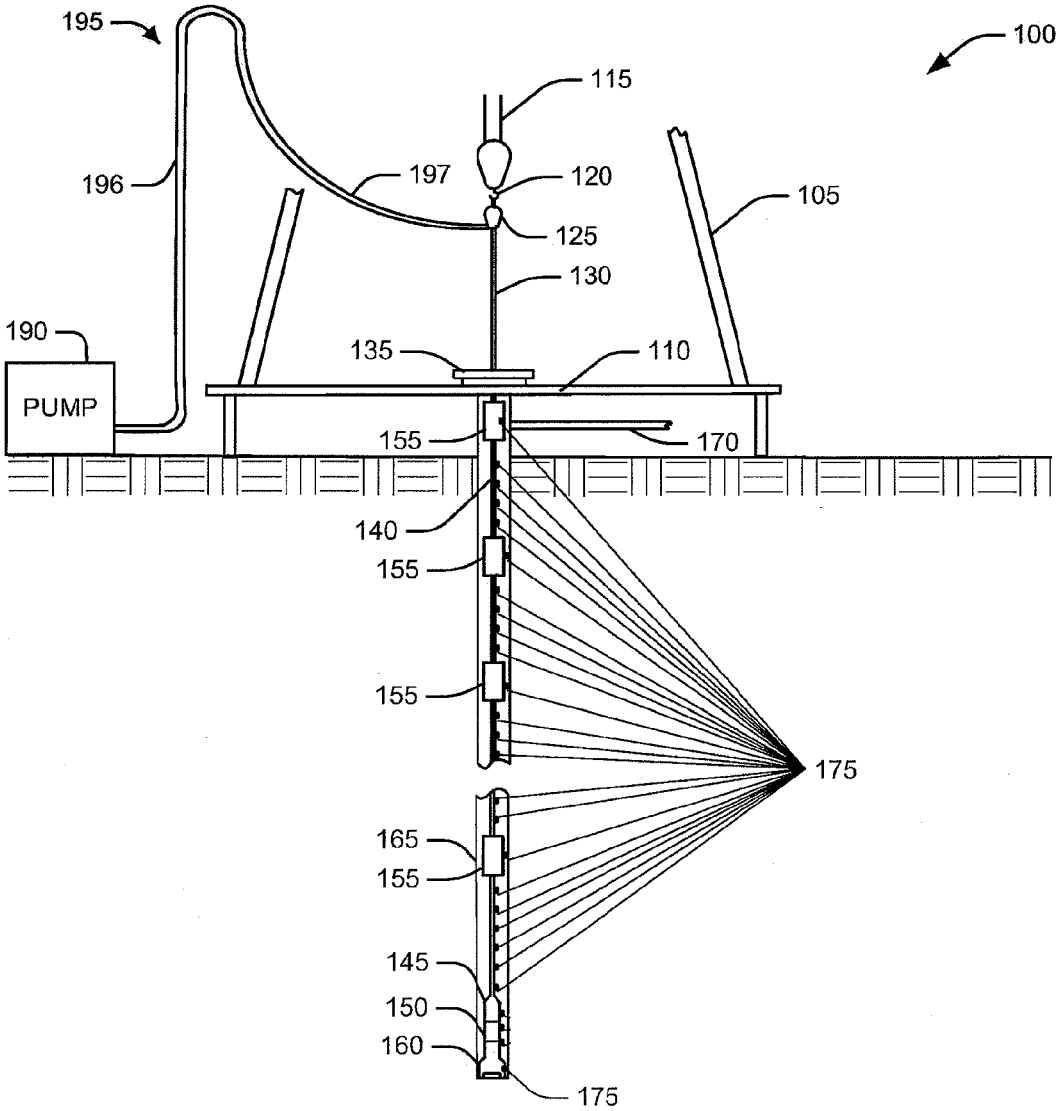
FIG. 1 shows an illustrative system for performing drilling operations.

As shown in FIG. 1, oil well drilling equipment 100 (simplified for ease of understanding) may include a derrick 105, derrick floor 110, draw works 115 (schematically represented by the drilling line and the traveling block), hook 120, swivel 125, kelly joint 130, rotary table 135, drillpipe 140, one or more drill collars 145, one or more MWD/LWD tools 150, one or more subs 155, and drill bit 160. Drilling fluid is injected by a mud pump 190 into the swivel 125 by a drilling fluid supply line 195, which may include a standpipe 196 and kelly hose 197. The drilling fluid travels through the kelly joint 130, drillpipe 140, drill collars 145, and subs 155, and exits through jets or nozzles in the drill bit 160. The drilling fluid then flows up the annulus between the drillpipe 140 and the wall of the borehole 165. One or more portions of borehole 165 may comprise an open hole and one or more portions of borehole 165 may be cased. The drillpipe 140 may be comprised of multiple drillpipe joints. The drillpipe 140 may be of a single nominal diameter and weight (i.e., pounds per foot) or may comprise intervals of joints of two or more different nominal diameters and weights. For example, an interval of heavy-weight drillpipe joints may be used above an interval of lesser weight drillpipe joints for horizontal drilling or other applications. The drillpipe 140 may optionally include one or more subs 155 distributed among the drillpipe joints. If one or more subs 155 are included, one or more of the subs 155 may include sensing equipment (e.g., sensors), communications equipment, data-processing equipment, or other equipment. The drillpipe joints may be of any suitable dimensions (e.g., 30 foot length). A drilling fluid return line 170 returns drilling fluid from the borehole 165 and circulates it to a drilling fluid pit (not shown) and then the drilling fluid is ultimately recirculated via the mud pump 190 back to the drilling fluid supply line 195. The combination of the drill collar 145, Measurement While Drilling ("MWD")/Logging While Drilling ("LWD") tools 150, and drill bit 160 is known as a bottomhole assembly (or "BHA"). The BHA may further include a bit sub, a mud motor (discussed below), stabilizers, jarring devices and crossovers for various threadforms. The mud motor operates as a rotating device used to rotate the drill bit 160. The different components of the BHA may be coupled in a manner known to those of ordinary skill in the art, such as, for example, by joints. The combination of the BHA, the drillpipe 140, and any included subs 155, is known as the drill string. In rotary drilling, the rotary table 135 may rotate the drill string, or alternatively the drill string may be rotated via a top drive assembly.

One or more force sensors 175 may be distributed along the drillpipe, with the distribution depending on the needs of the system. In general, the force sensors 175 may include one or more sensor devices to produce an output signal responsive to a physical force, strain or stress in a material. The sensor devices may comprise strain gauge devices, semiconductor devices, photonic devices, quartz crystal devices, or other devices to convert a physical force, strain, or stress on or in a material into an electrical or photonic signal. In certain embodiments, the force measurements may be directly obtained from the output of the one or more sensor devices in the force sensors 175. In other embodiments, force measurements may be obtained based on the output of the one or more sensor devices in conjunction with other data. For example, the measured force may be determined based on material properties or dimensions, additional sensor data (e.g., one or more temperature or pressure sensors), analysis, or calibration.

One or more force sensors 175 may measure one or more force components, such as axial tension or compression, or torque, along the drillpipe. One or more force sensors 175 may be used to measure one or more force components reacted to by or consumed by the borehole, such as borehole-drag or borehole-torque, along the drillpipe. One or more force sensors 175 may be used to measure one or more other force components such as pressure-induced forces, bending forces, or other forces. One or more force sensors 175 may be used to measure combinations of forces or force components. In certain implementations, the drill string may incorporate one or more sensors to measure parameters other than force, such as temperature, pressure, or acceleration.

In one example implementation, one or more force sensors 175 are located on or within the drillpipe 140. Other force sensors 175 may be on or within one or more drill collars 145 or the one or more MWD/LWD tools 150. Still other force sensors 175 may be in built into, or otherwise coupled to, the bit 160. Still other force sensors 175 may be disposed on or within one or more subs 155. One or more force sensors 175 may provide one or more force or torque components experienced by the drill string at surface. In one example implementation, one or more force sensors 175 may be incorporated into the draw works 115, hook 120, swivel 125, or otherwise employed at surface to measure the one or more force or torque components experienced by the drill string at the surface.

The one or more force sensors 175 may be coupled to portions of the drill string by adhesion or bonding. This adhesion or bonding may be accomplished using bonding agents such as epoxy or fasters. The one or more force sensors 175 may experience a force, strain, or stress field related to the force, strain, or stress field experienced proximately by the drill string component that is coupled with the force sensor 175.

Other force sensors 175 may be coupled so as to not experience all, or a portion of, the force, strain, or stress field experienced by the drill string component coupled proximate to the force sensor 175. Force sensors 175 coupled in this manner may, instead, experience other ambient conditions, such as one or more of temperature or pressure. These force sensors 175 may be used for signal conditioning, compensation, or calibration.

The force sensors 175 may be coupled to one or more of: interior surfaces of drill string components (e.g., bores), exterior surfaces of drill string components (e.g., outer diameter), recesses between an inner and outer surface of drill string components. The force sensors 175 may be coupled to one or more faces or other structures that are orthogonal to the axes of the diameters of drill string components. The force sensors 175 may be coupled to drill string components in one or more directions or orientations relative to the directions or orientations of particular force components or combinations of force components to be measured.

In certain implementations, force sensors 175 may be coupled in sets to drill string components. In other implementations, force sensors 175 may comprise sets of sensor devices. When sets of force sensors 175 or sets of sensor devices are employed, the elements of the sets may be coupled in the same, or different ways. For example, the elements in a set of force sensors 175 or sensor devices may have different directions or orientations, relative to each other. In a set of force sensors 175 or a set of sensor devices, one or more elements of the set may be bonded to experience a strain field of interest and one or more other elements of the set (i.e., "dummies") may be bonded to not experience the same strain field. The dummies may, however, still experience one or more ambient conditions. Elements in a set of force sensors 175 or sensor devices may be symmetrically coupled to a drill string component. For example three, four, or more elements of a set of sensor devices or a set of force sensors 175 may spaced substantially equally around the circumference of a drill string component. Sets of force sensors 175 or sensor devices may be used to: measure multiple force (e.g., directional) components, separate multiple force components, remove one or more force components from a measurement, or compensate for factors such as pressure or temperature. Certain example force sensors 175 may include sensor devices that are primarily unidirectional. Force sensors 175 may employ commercially available sensor device sets, such as bridges or rosettes.

Figure 2:
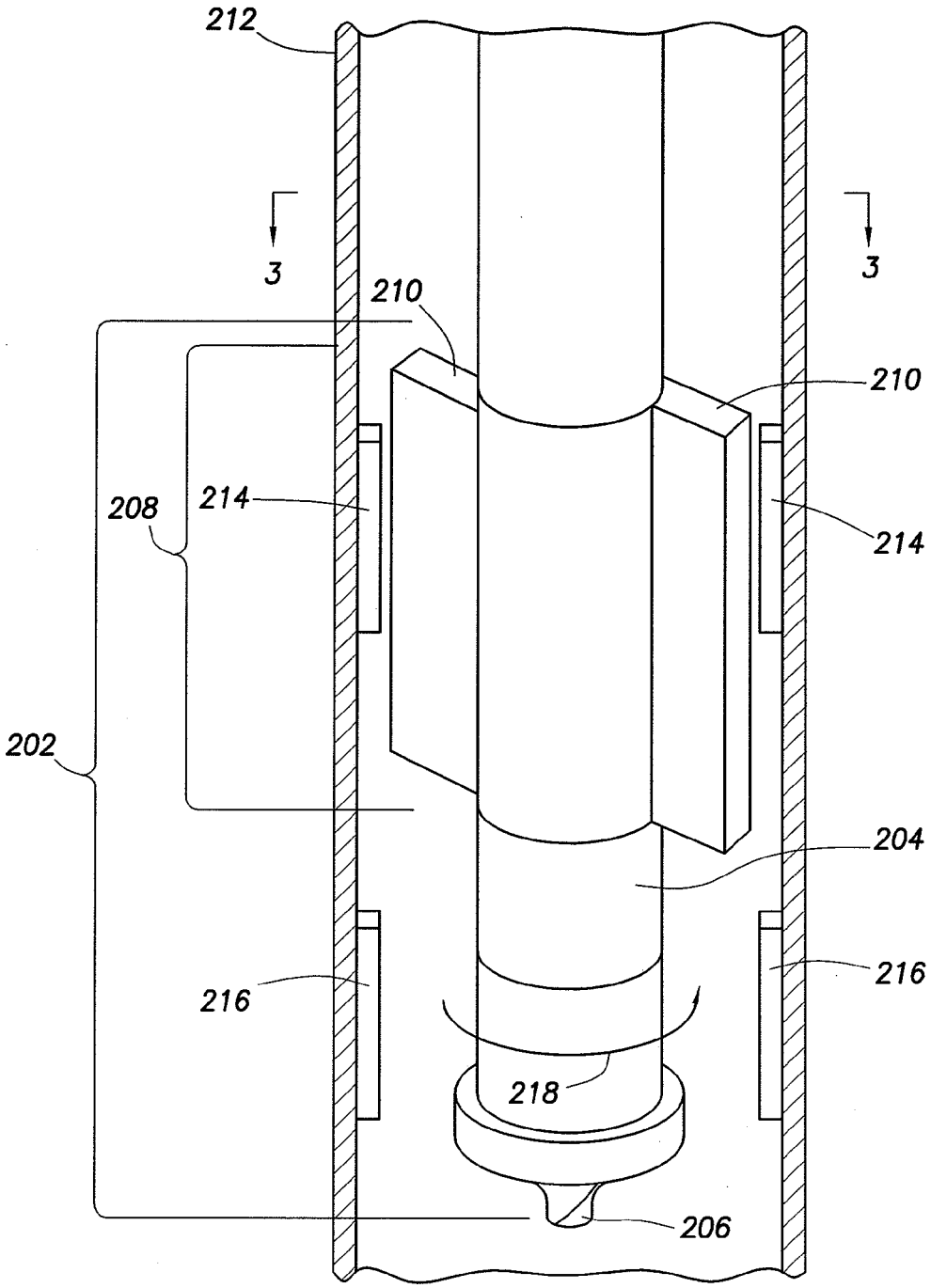
FIG. 2 shows an illustrative improved drilling system in accordance with an exemplary embodiment of the present invention.

FIG. 2 depicts an improved drilling system in accordance with an exemplary embodiment of the present invention. As discussed above, the BHA 202 may include a number of different components, including a mud motor 204 and a drill bit 206. As would be appreciated by those of ordinary skill in the art, with the benefit of this disclosure, the mud motor 204 is typically a positive displacement drilling motor that uses the hydraulic power of the drilling fluid to drive the drill bit 206. In accordance with an exemplary embodiment of the present invention, the BHA 202 may include an optionally non-rotatable portion 208. The optionally non-rotatable portion 208 of the BHA 202 may include any of the components of the BHA 202 excluding the mud motor 204 and the drill bit 206. For instance, the optionally non-rotatable portion 208 may include drill collar 145, the MWD/LWD tools 150, bit sub, stabilizers, jarring devices and crossovers.

As shown in FIG. 2, the optionally non-rotatable portion 208 of the BHA 202 may further include one or more bars 210 extending along a portion thereof. Although the bars 210 of the exemplary embodiment of FIG. 2 are shown to extend along the whole length of the optionally non-rotatable portion 208, as would be appreciated by those of ordinary skill in the art, with the benefit of this disclosure, in another exemplary embodiment the bars 208 may extend along part of the optionally non-rotatable portion 208 length. The bars 210 may be made of any suitable materials, including, but not limited to copper, brass, or steel.

During the drilling and construction of subterranean wellbores, casing strings are generally introduced into the wellbore. To stabilize the casing, a cement slurry is often pumped downwardly through the casing, and then upwardly into the annulus between the casing and the walls of the wellbore. The casing may perform several functions, including, but not limited to, protecting fresh water formations near the wellbore, isolating a zone of lost return or isolating formations with significantly different pressure gradients. Accordingly, as shown in FIG. 2, a casing 212 may extend along a portion of the wellbore covering an inner surface thereof. In accordance with an exemplary embodiment of the present invention, the casing 212 may include one or more sets of projections along its length. In the exemplary embodiment of FIG. 2, the casing 212 includes a first set of projections 214 and a second set of projections 216 located down hole relative to the first set of projections 214. Each set of projections may include one or more projections that are positioned at different radial locations at substantially the same depth in the wellbore. In one embodiment, the projections in each set 214, 216 may be symmetrically positioned along the inner perimeter of the casing 212.

Figure 3:
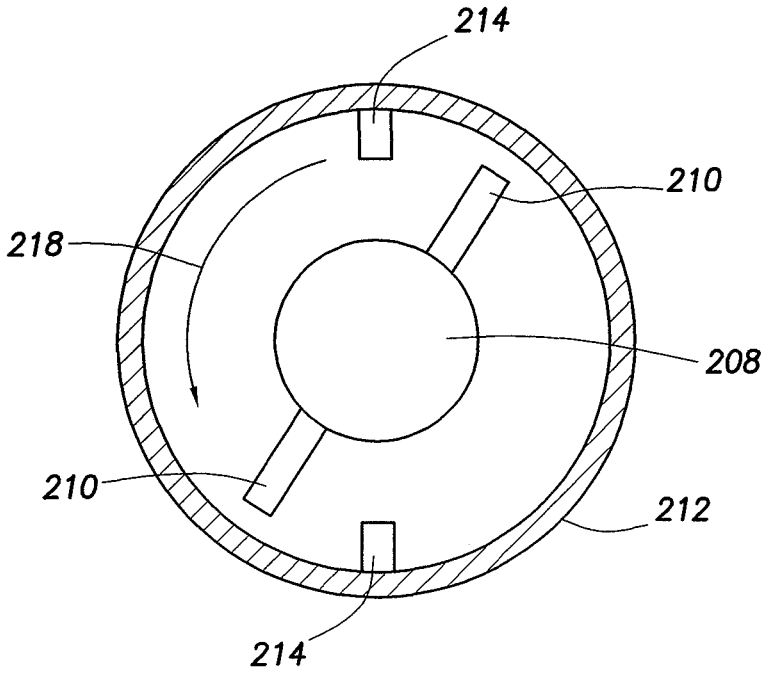
FIG. 3 shows top cross-sectional view of the system of FIG. 2.

FIG. 3 depicts a top view of a drilling system in accordance with an exemplary embodiment of the present invention. Specifically, FIG. 3 depicts a top cross-sectional view of the system of FIG. 2, including the first projection set 214, the optionally non-rotatable portion 208 and the bars 210.

During drilling operations, the force generated by the mud motor 204 to rotate the drill bit 206 may also rotate the remaining portions of the BHA 202. FIGS. 2 and 3 show a torque 218 that in one exemplary embodiment may be applied in the counter-clockwise direction. In accordance with an embodiment of the present invention, the drilling system may be equipped with a rotational hold down system 200 consisting of at least one bar 210 and a projection set 214. Specifically, as the optionally non-rotatable portion 208 of the BHA 202 rotates, the bars 210 rotate until they come in contact with the projections of the first projection set 214 which is located at a first depth in the wellbore. Once the bars 210 interface (i.e., come in contact) with the projections of the first projection set 214, the optionally non-rotatable portion 208 of the BHA 202 can no longer rotate. Accordingly, the projection set 214 can control the rotation of the optionally non-rotatable portion 208 of the BHA 202. Once the bars 210 come in contact with the first projection set 214, the optionally non-rotatable portion 208 provides a stiff support for the mud motor 204 and the supplied torque 218 will be directed to the drill bit 206. Moreover, because the rotation of the optionally non-rotatable portion 208 is limited by the interaction of the bars 210 with the first projection set 214, unwanted torque transfer to portion of the BHA 202 as well as the remaining portions of the drill string may be reduced or prevented.

In one embodiment, as the drilling operations continue and the BHA 202 moves down hole, there will come a time when the bars 210 have passed the first set of projections 214. In one embodiment, the second set of projections 216 may be positioned at a second depth such that they can provide an interface for the bars 210 to control the rotation of the optionally non-rotatable portion 208 once the BHA 202 reaches a second depth in the wellbore. In this manner, different sets of projections may be used to control the rotation of the optionally non-rotatable portion 208 of the BHA 202 at different locations in the wellbore.

As would be appreciated by those of ordinary skill in the art, with the benefit of this disclosure, the present invention is not limited by the number of bars on the optionally non-rotatable portion of the BHA, the number of projections in each projection set, the number of sets of projections in the casing or the distance between the projection sets. Accordingly, any desirable number or arrangement of bars and projections may be used. As would be appreciated by those of ordinary skill in the art, with the benefit of this disclosure, the length of the bars 210 and the separation of the different projection sets 214, 216 may be designed such that as the drill bit 206 penetrates the formation, there is always a projection set that can interface with the bars 210 and prevent the rotation of the optionally non-rotatable portion 208 of the BHA 202. In one exemplary embodiment, the projection sets 214, 216 may be 40 ft. apart. Further, in one embodiment, the bars 210 may extend 40 ft. along the outer surface of the optionally non-rotatable portion 208. Additionally, the bars 210 and the projection sets 214, 216 may be designed by the operator so as to meet different field conditions. For instance, in one exemplary embodiment, the bars 210 and the projection sets 214. 216 may be designed to withstand a torque of 2000 ft.lbs.

In one exemplary embodiment, the projections of the projection sets 214 and 216 may be designed to be retractable into the casing 212. In this embodiment, the operator may selectively activate or deactivate the projections to control whether the optionally non-rotatable portion 208 of the BHA 202 can rotate. Similarly, in one embodiment, the bars 210 may be designed to be retractable into the optionally non-rotatable portion 208 of the BHA 202. Design and implementation of retractable components is well known to those of ordinary skill in the art and will therefore not be discussed in detail herein. Moreover, in one exemplary embodiment, the bars 210 may be detachably attached to the optionally non-rotatable portion 208 of the BHA 202. Similarly, the projections 214, 216 may be integrally formed with the casing 212 or be detachably attached thereon. In one exemplary embodiment, the projections may be made of cast iron. The detachable attachment of the bars 210 and/or projection sets 214, 216 makes it easier to replace or repair them in case they are damaged during the drilling operations.

Although the rotational hold down system 200 of FIGS. 2 and 3 is shown as being located on the optionally non-rotatable portion 208, as would be appreciated by those of ordinary skill in the art, with the benefit of this disclosure, the same methods and systems may be used by placing the rotational hold down system 200 in other locations along the drill string. For instance, in one exemplary embodiment, the rotational hold down system 200 may be placed on the drillpipe 140.

Figure 4:
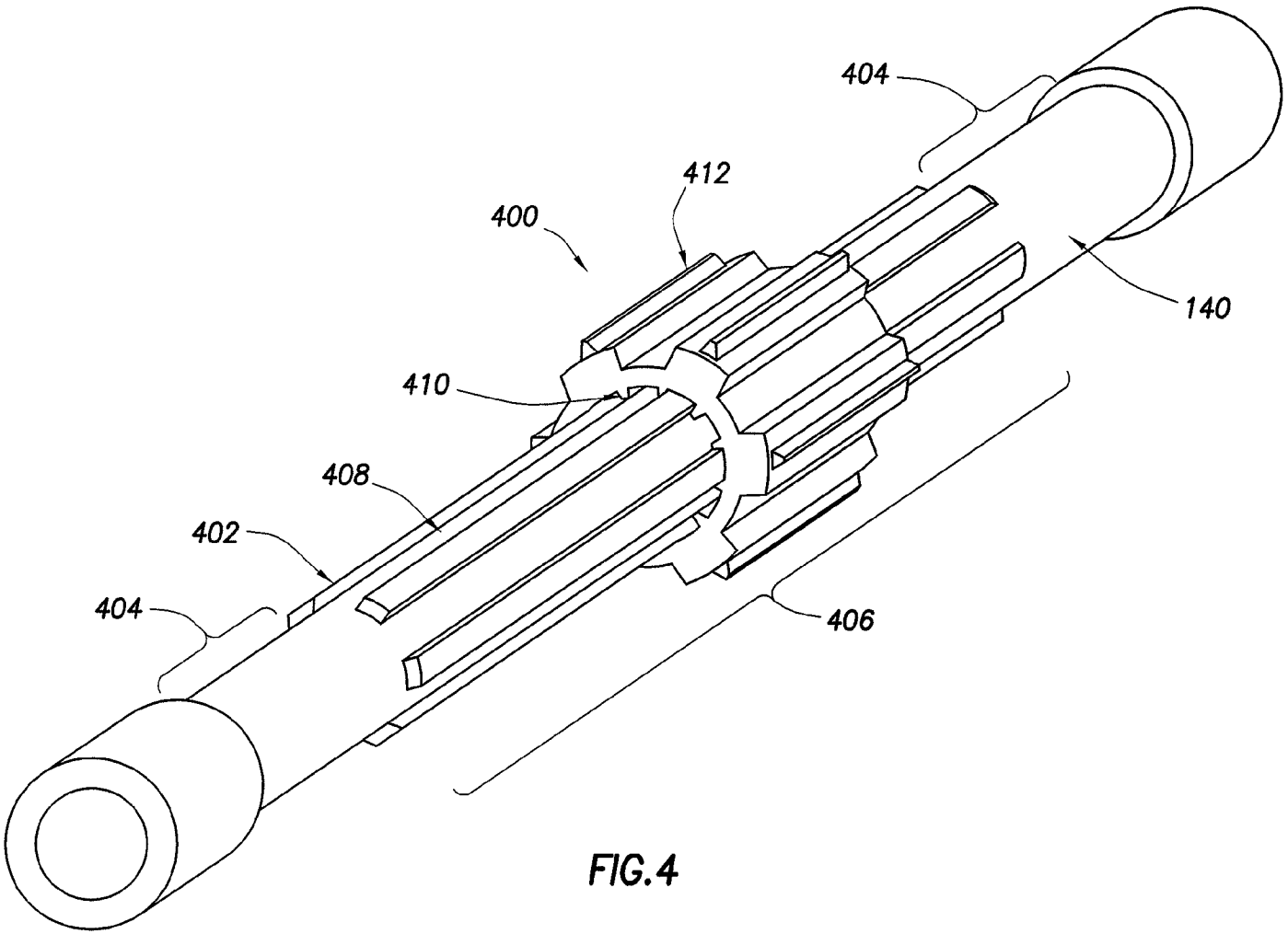
FIG. 4 shows a rotational hold down system in accordance with another exemplary embodiment of the present invention.

FIG. 4 shows a rotational hold down system 400 in accordance with another exemplary embodiment of the present invention. In this exemplary embodiment, the rotational hold down system 400 is depicted as being disposed on the drillpipe 140. However, as would be appreciated by those of ordinary skill in the art, with the benefit of this disclosure, the rotational hold down system 400 may be placed at any position in the drilling system, such as, for example, on the optionally non-rotatable portion 208 of the BHA 202 as discussed above in conjunction with FIGS. 2 and 3. In one embodiment, the rotational hold down system 400 is disposed around the perimeter of the drillpipe 140 and is movable along the drillpipe 140. The drillpipe 140 may include a first portion 404 that does not have projections and grooves. The outer perimeter of the drillpipe 140 may include projections 402 running along a second portion 406 that form slats 408 thereon. The rotational hold down system 400 may include lugs 410 that may engage the slats 408 and the outside surface of the rotational hold down system 400 may include bars 412. The bars 412 may be made of any suitable materials, such as, for example, steel or carbide re-enforced steel. The bars 412 may interface with the casing or wellbore wall and thereby substantially prevent the rotational movement of the rotational hold down assembly 400.

In operation, the rotational hold down system 400 may initially be at a first position on the first portion 404 of the drillpipe 140. When in this position, the lugs 410 do not engage the slats 408 on the drillpipe 140. Accordingly, the drillpipe 140 may be moved independently of the rotational hold down system 400 and the two are not rotationally coupled. Therefore, in this position, although the rotational hold down assembly 400 is rotationally held in place by the bars 412, the drillpipe 140 may freely rotate. When it is desirable to inhibit the rotation of the drillpipe 140, the rotational hold down system 400 may be moved to a second position on the second portion 406 of the drillpipe. Once in the second position, the lugs 410 engage the slats 408 rotationally coupling the drillpipe 140 to the rotational hold down system 400. Accordingly, in the second position, the bars 412 substantially prevent the rotational movement of the drillpipe 140.

As would be appreciated by those of ordinary skill in the art, with the benefit of this disclosure, the movement of the rotational hold down system 400 between the first position and the second position may be controlled by any suitable means. For instance, in one exemplary embodiment, the rotational hold down assembly 400 may be spring loaded. In another exemplary embodiment, the positioning of the rotational hold down assembly 400 may be remotely controlled by the operator. Methods and systems for remotely controlling the movement of components are well known to those of ordinary skill in the art and will therefore not be discussed in detail herein.

Figure 5A:
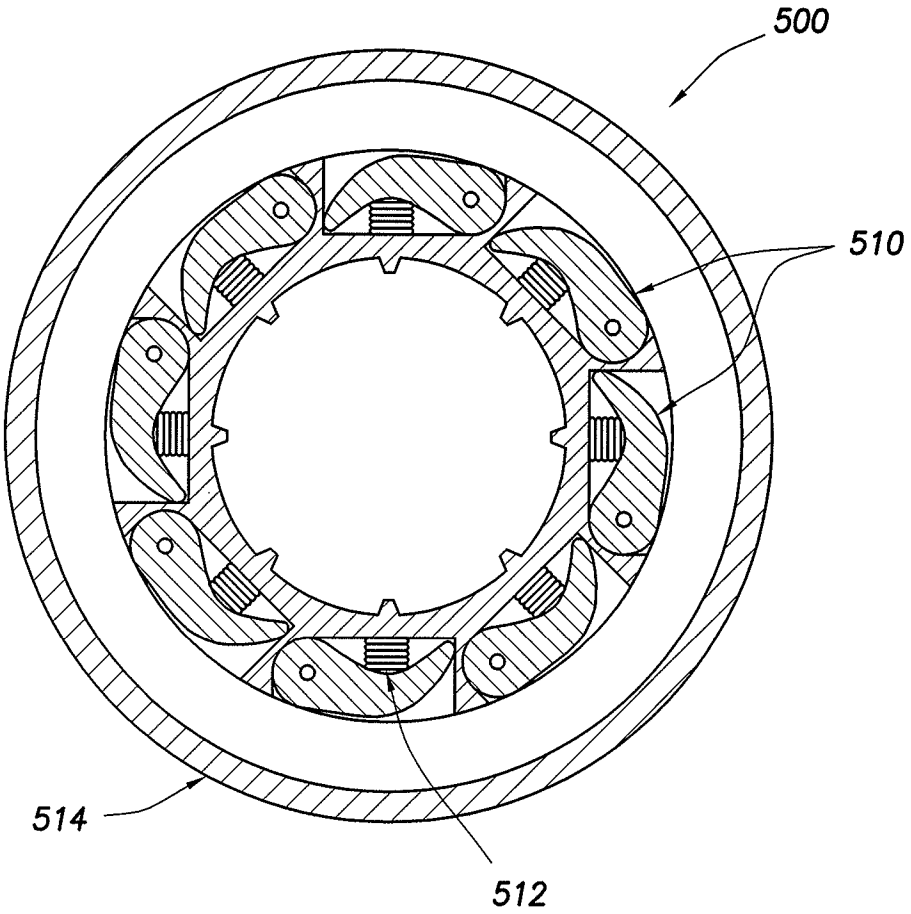
FIGS. 5*a* and 5*b* depict a rotational hold down system in accordance with another exemplary embodiment of the present invention in the retracted and extended state, respectively.
Figure 5B:
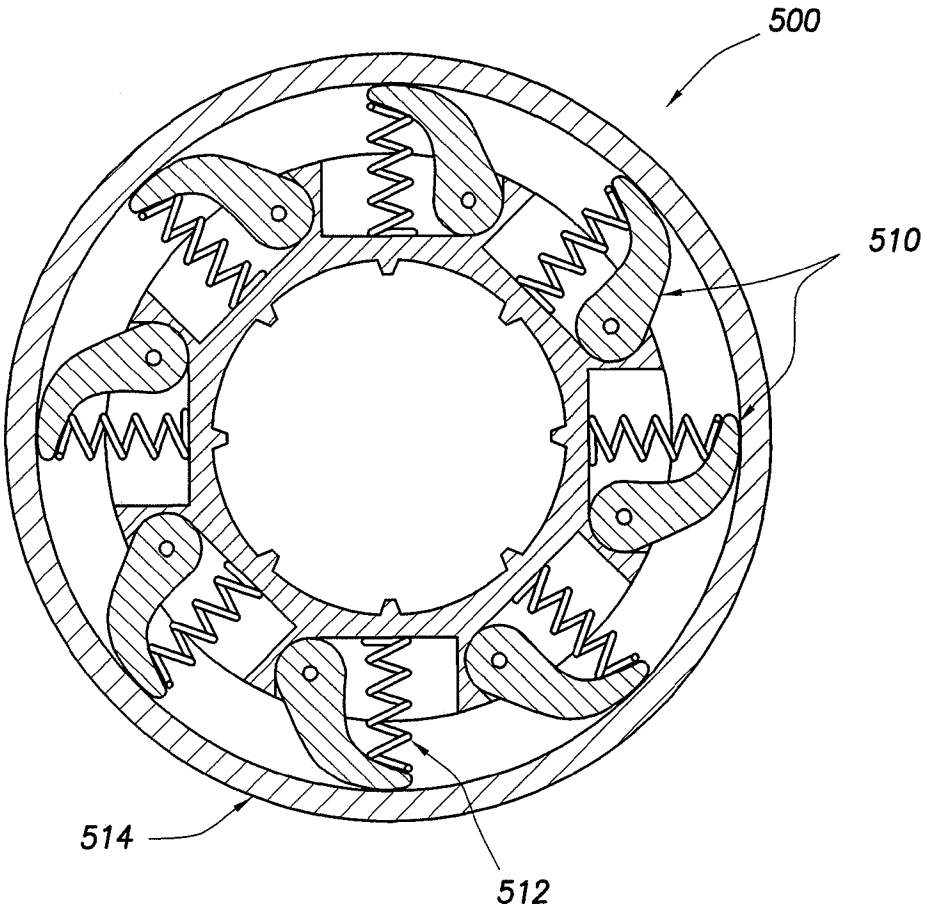

FIGS. 5*a* and 5*b* depict a rotational hold down system 500 in accordance with another exemplary embodiment of the present invention. In this embodiment, the bars 210 of FIGS. 2 and 3 may be replaced by a number of spring activated bars 510. As shown in FIGS. 5*a* and 5*b*, the spring activated bars 510 may be extended or retracted using by controlling the springs 512. As would be appreciated by those of ordinary skill in the art, with the benefit of this disclosure, the present invention is not limited to any specific number of spring activated bars 510 and the number of spring activated bars 510 may be determined by the user based on design parameters. For instance, in one exemplary embodiment, a single spring activated bar 510 may be used. In other exemplary embodiments, a plurality of spring activated bars may be symmetrically or asymmetrically placed around the outer surface of the rotational hold down system 500. Each spring activated bar 510 may include a corresponding spring 512.

In operation, in an initial state, the spring activated bars 510 may be in a collapsed state as shown in FIG. 5*a*. The rotational hold down system 500 may further include a tapered mandrel equipped with a j-slot arrangement that may be used to extend or collapse the spring activated bars 510. In one exemplary embodiment, the contact point of the spring activated bars 510 with the surrounding casing 514 or wellbore wall may include teeth that are axially formed with respect to the wellbore axis. The spring activated bars 510 may be expanded as shown in FIG. 5*b* when activated.

Figure 6:
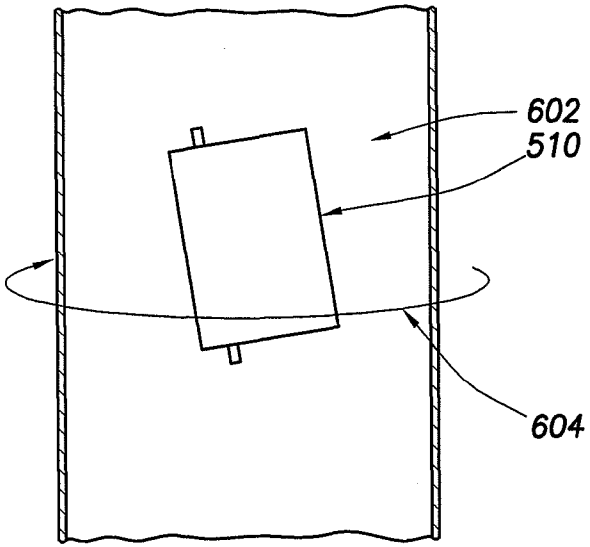
FIG. 6 is a side view of the rotational hold down system of FIG. 5.

FIG. 6 is a side view of the rotational hold down system 500 of FIG. 5. As shown in FIG. 6, in one exemplary embodiment, the spring activated bars 510 may be angled relative to the optionally non-rotatable portion to, for example, face slightly upwards. Accordingly, the rotational hold down system 500 may permit the downward movement of the drill string. Specifically, the downward movement of the drill string 602 will unset the pressure of the spring activated bars 510 on the casing 514 or the wellbore wall permitting the downward movement of the drill string. However, as would be appreciated by those of ordinary skill in the art, with the benefit of this disclosure, in an embodiment with the tilted spring activated bars 510, the downward movement of the drill string may produce a torque on the drill string. For instance, in the exemplary embodiment of FIG. 6, a downward movement of the drill string 602 slowly generates a torque 604 causing a left-hand turn motion. This motion may eventually place a high torque on drill string 602 components. In one exemplary embodiment with a tilted spring activated bar 510 the drill bit 160 may be occasionally relaxed, causing the spring activated bars 510 to be rotated in the opposite direction and thereby relaxing the torque 604.

Figure 7:
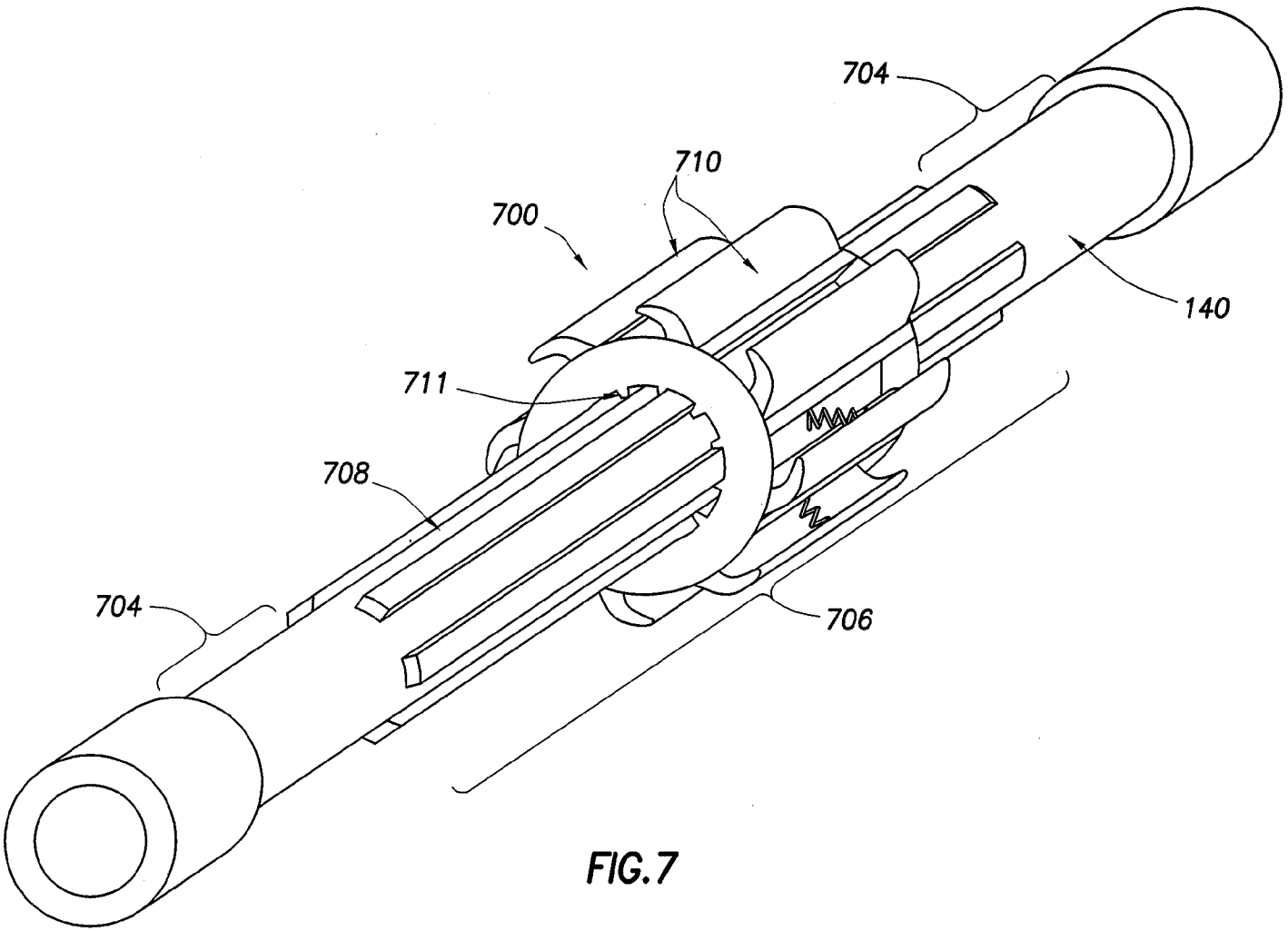
FIG. 7 shows a rotational hold down system in accordance with another exemplary embodiment of the present invention.

In one exemplary embodiment, as shown in FIG. 7, the rotational hold tool system 500 of FIGS. 5 and 6 may be combined with the embodiment of FIG. 4. Specifically, a rotational hold tool system 700 may be provided that includes spring activated bars 710. The rotational hold tool system 700 may further include lugs 710 that engage grooves 708 on a portion of the drill string, such as, for example, the drillpipe 140. Accordingly, as discussed above in conjunction with FIG. 4, the rotational hold tool system 700 may be placed in a first position on the first portion 704 of the drillpipe 140 where it permits the rotation of the drill string. Alternatively, the rotational hold tool system 700 may be moved to a second position at a second portion 706 of the drillpipe 140 where it prohibits the rotational movement of the drillpipe 140.

Using the rotational hold tool system 700 of FIG. 7, the drilling operations need not be stopped in order to unset the spring activated bars 710. In one exemplary embodiment, a mandrel may be coupled to the drill string. The mandrel may hold the spring activated bars 710 with a spline, a hexagonally shaped tubing or other suitable means. The mandrel may further include a spring. In one exemplary embodiment, the spring on the mandrel may push the spring activated bars 710 while the drill string pushes down the drill bit 160, thereby placing the spring activated bars 710 in a retracted position. As the drilling operations continue, the drill string moves downhole. Once the drill string moves downhole by a predetermined distance, the mandrel may permit the spring activated bars 710 to move to their extended position. With the spring activated bars 710 released, the rotational hold down system is activated and substantially prevents the rotation of the optionally non-rotatable portion of the drill string. As drilling operations continue, the mandrel moves back downhole over the spring activated bars 710 and the process continues until drilling operations are completed. Accordingly, as would be appreciated by those of ordinary skill in the art, with the benefit of this disclosure, the mandrel may be designed to retract and extend the spring activated bars 710 as the drill string moves downhole for a predetermined distance.

Figure 8A:
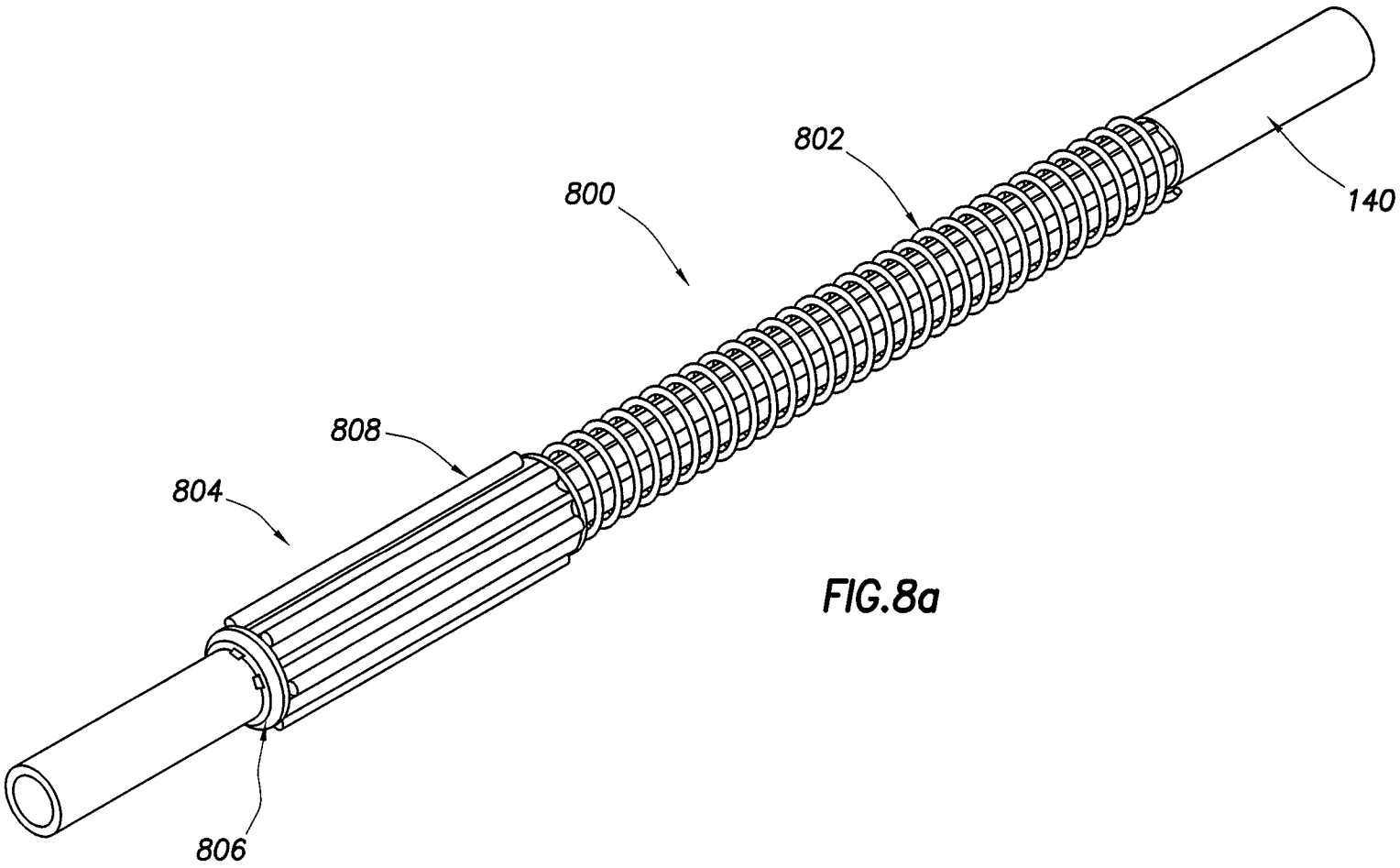
FIGS. 8*a* and 8*b* show a rotational hold down system in accordance with yet another exemplary embodiment of the present invention.
Figure 8B:
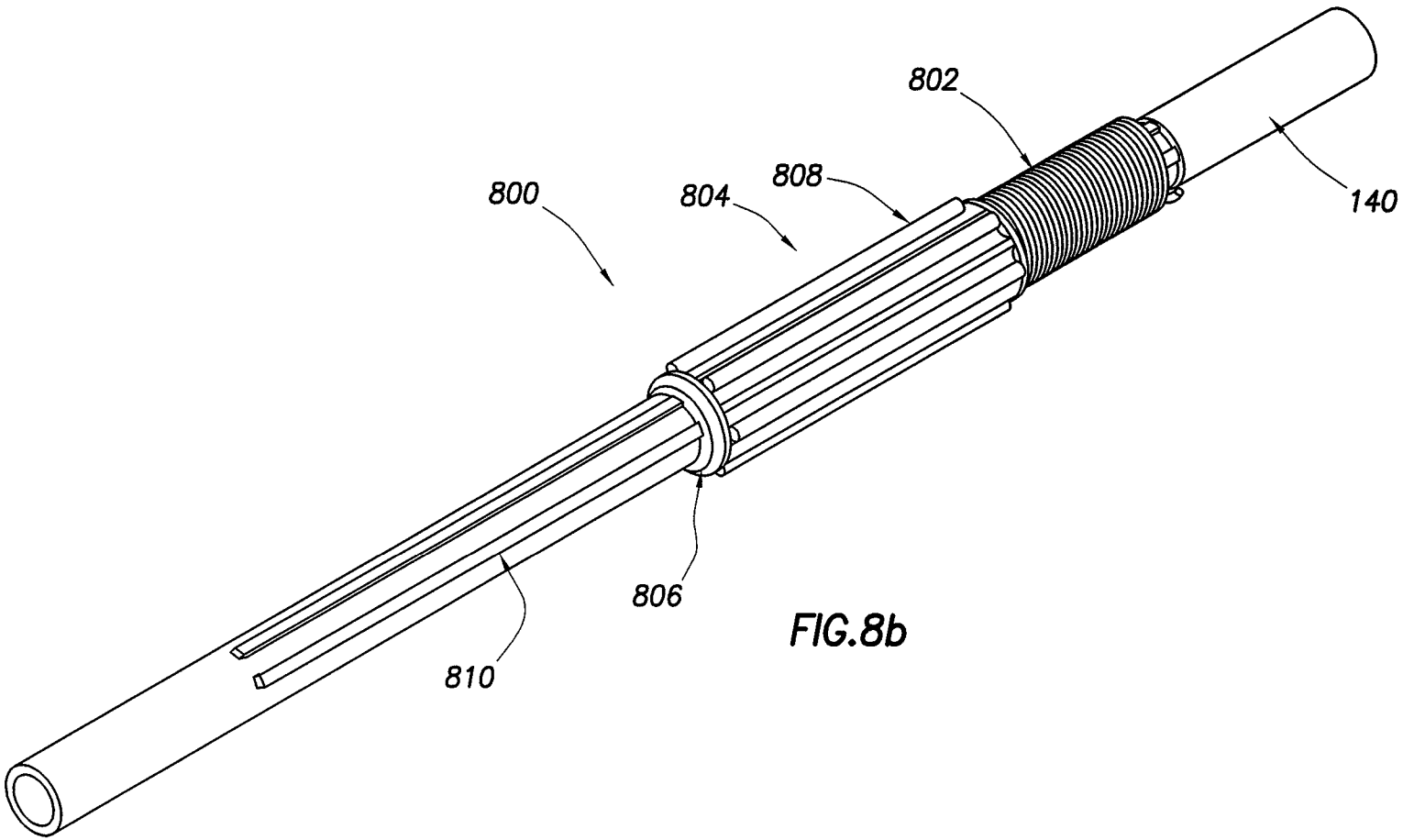
Figure 9:
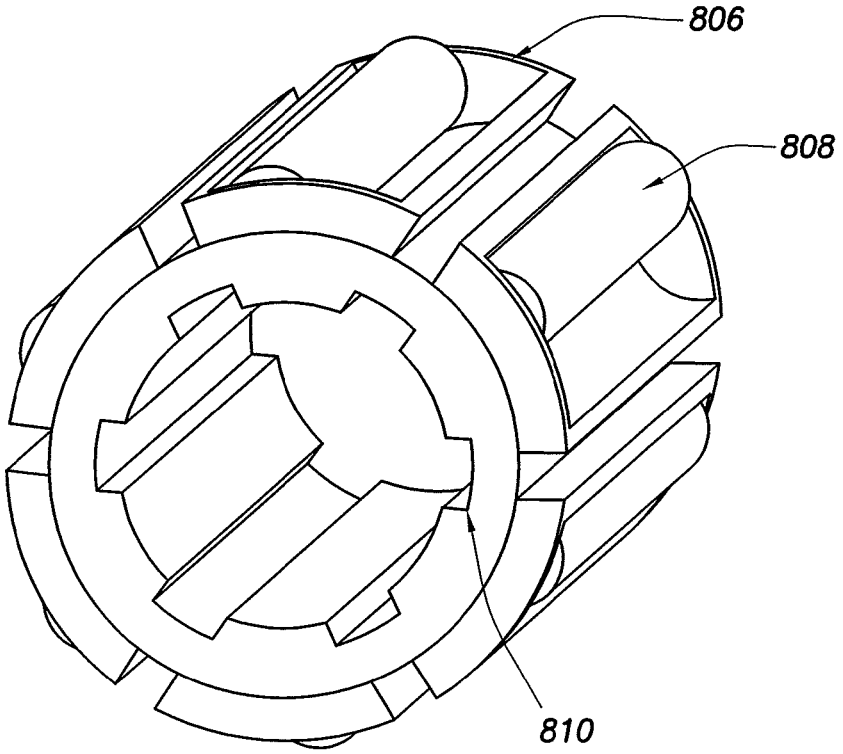
FIG. 9 shows the protrusions of the expandable portion of FIG. 8 in the retracted position.
Figure 10:
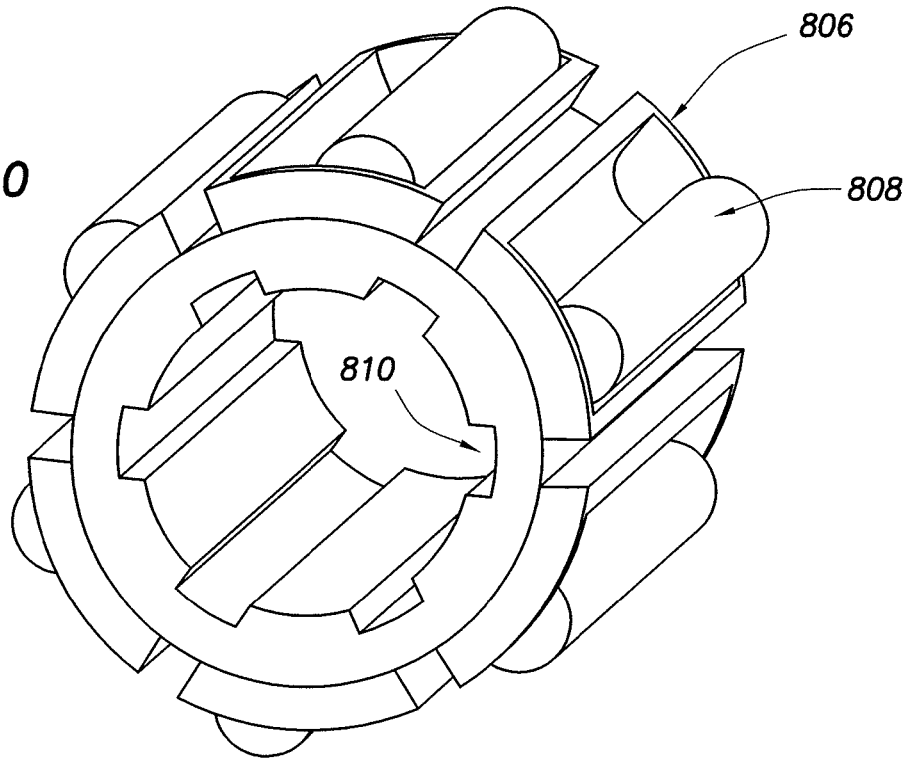
FIG. 10 shows the protrusions of the expandable portion of FIG. 8 in the extended position.

FIGS. 8*a* and 8*b* depict a rotational hold down system 800 in accordance with another exemplary embodiment of the present invention. The rotational hold down system 800 may include a spring 802 and an expandable portion 804. The expandable portion 804 may include a housing 806 having protrusions 808. The expandable portion may further include grooves 810 that engage the drill pipe 140 and rotationally couple the drill pipe 140 to the expandable portion 804. As the drilling operations continue, the drill pipe 140 may slide up or down through the expandable portion 804 grooves. For instance, as shown in FIG. 8*b*, the spring 802 may be compressed and the expandable portion 804 may be pulled up over the grooves on the drill pipe 140 as the drill pipe 140 is moved downhole during drilling operations. FIG. 9 shows the protrusions 808 in the retracted position and FIG. 10 shows the protrusions 808 in the extended position. In accordance with an embodiment of the present disclosure, as shown in FIG. 8*b*, the protrusions 808 may be deactivated when it is not desirable to prevent rotation. In one embodiment, the protrusions 808 may rotated to extend out of the expandable portion 804 or retract into the expandable portion 804.

Figure 11A:
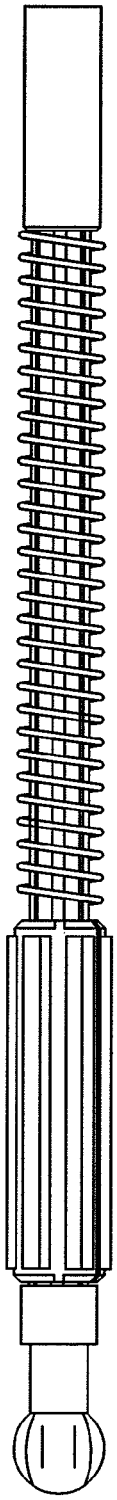
FIGS. 11*a* and 11*b* show operation of a rotational hold down system of FIG. 8 in accordance with an exemplary embodiment of the present invention.
Figure 11B:
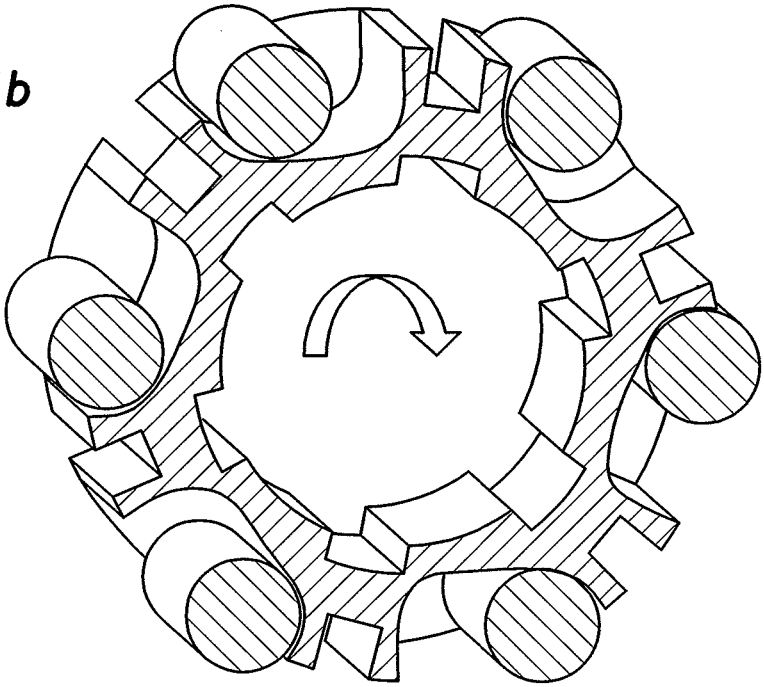

FIGS. 11 and 12 depict the use of a rotational hold down system 800 in drilling operations in accordance with an exemplary embodiment of the present invention. As shown in FIG. 11*a*, as the drilling operations proceed, the coil tubing may be turned counterclockwise due to the torque applied during the drilling operation. FIG. 11*b* shows a bottom view of the expandable portion 804 with protrusions 808. As the coil rotates, the protrusions 808 of the expandable portion 804 may move to their expanded position (as shown in FIGS. 10 and 11*b*) thereby interfacing with the surrounding casing or wellbore wall and rotationally locking the expandable portion 804 in place. Because the drill pipe 140 is rotationally coupled to the expandable portion 804, it also no longer rotates.

Figure 12A:
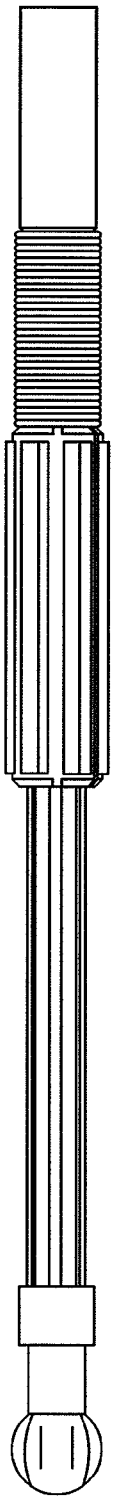
FIGS. 12*a* and 12*b* show operation of a rotational hold down system of FIG. 8 in accordance with an exemplary embodiment of the present invention.
Figure 12B:
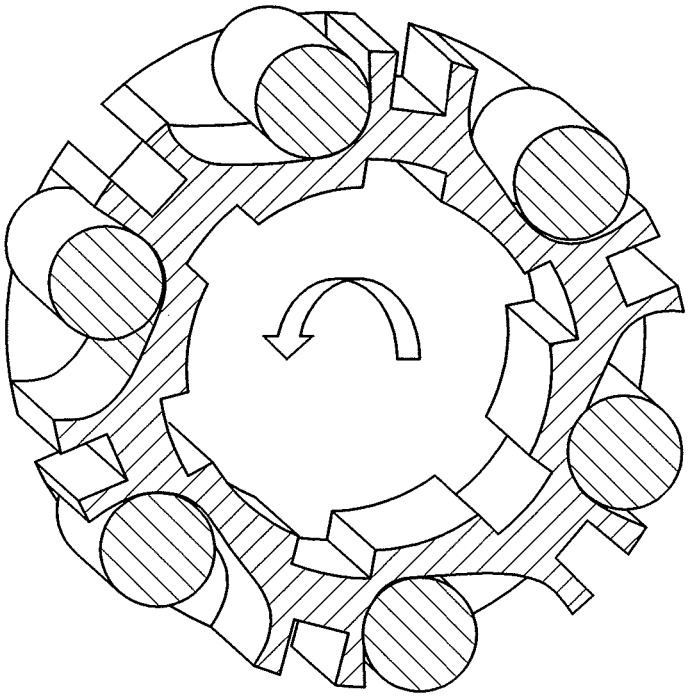

As the drilling operations continue, the drill pipe 140 which is slidably movable through the expandable portion 804 continues to move downhole and the spring 802 is compressed as shown in FIG. 12*a*. As the stroke is maximized, drilling action can no longer proceed and the drilling torque is relaxed. With the drilling torque relaxed, the coil tubing may be twisted back and the protrusions 808 return to their retracted position as shown in FIG. 12*b*. As the protrusions 808 return to their retracted position, they rotationally unlock the expandable portion 804 and the drill pipe 140. The spring 802 may then snap back to its original position as shown in FIG. 11*a* and the drill pipe may move freely downward and the drilling operations may continue. The above steps may be repeated until the drilling operations are completed.

FIGS. 13*a-d* show the operation of a rotational hold down system in accordance with another exemplary embodiment of the present invention. The rotational hold down system may include a spring 1302 coupled to an expandable portion 1304. The expandable portion 1304 may include a housing 1306 and a number of retractable protrusions 1308. In one exemplary embodiment, the expandable portion 1304 may include 6 retractable protrusions 1308. As would be appreciated by those of ordinary skill in the art, with the benefit of this disclosure, the methods and systems disclosed herein are not limited to a specific number of retractable protrusions 1308 and an embodiment with 6 slots is used herein for illustrative purposes only.

Figure 13A:
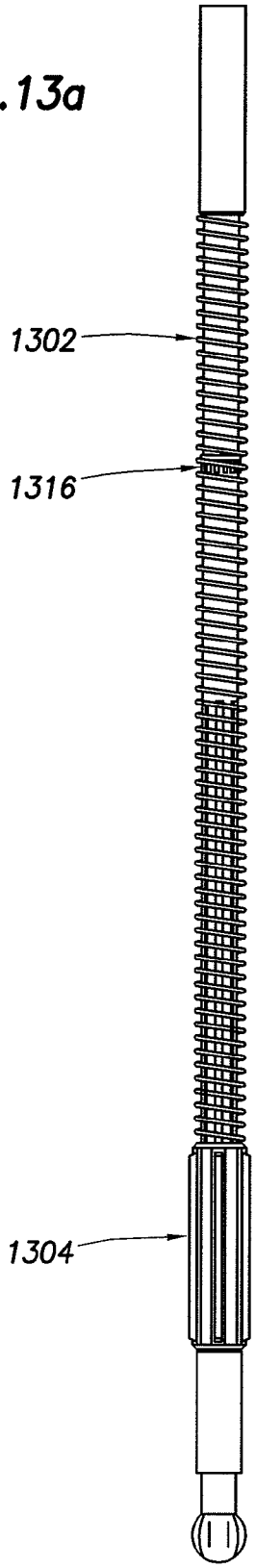
FIGS. 13*a-d* shows operation of a rotational hold down system of FIG. 8 in accordance with an exemplary embodiment of the present invention.
Figure 13B:
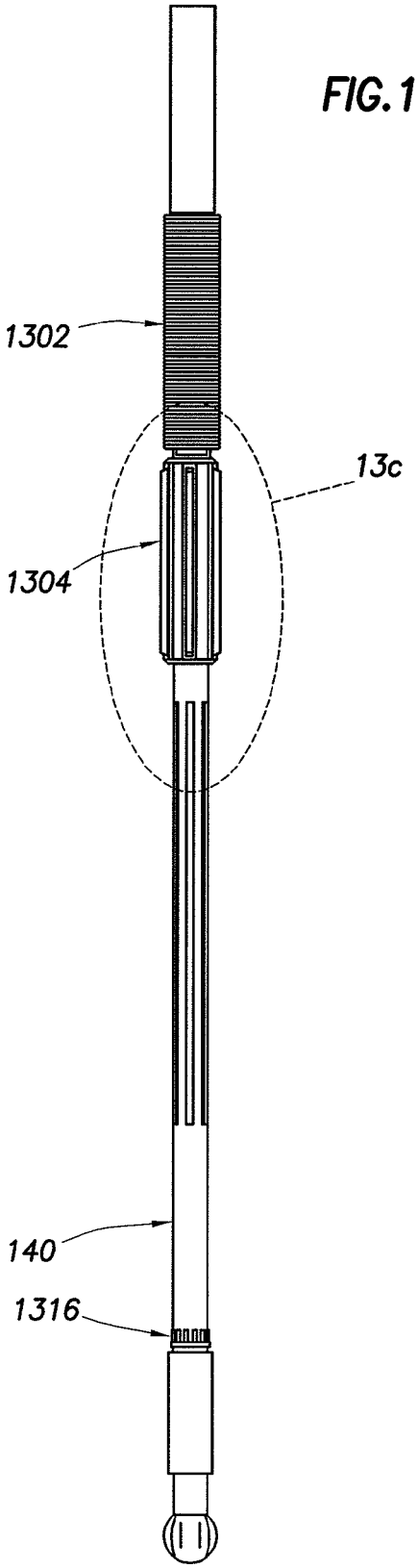
Figure 13D:
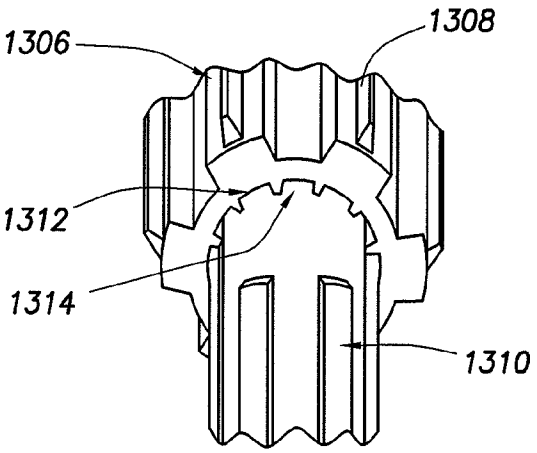

In one embodiment, the drill pipe 140 may include a number of slats 1310 corresponding to the retractable protrusions 1308. In one exemplary embodiment, the drill pipe 140 may include 6 slats 1310. The housing 1306 may include a number of slots that may engage the slats 1310. In one exemplary embodiment, the housing may include a pair of slots 1312, 1314 for each retractable protrusion 1308 and slat 1310 combination as shown in FIG. 13*d*. As shown in FIG. 13*d*, one of the slots 1314 in each pair may correspond to a position where the slat 1310 is lined up with the corresponding retractable protrusion 1308 and another slot 1312 in each pair may correspond to a position where the slat 1310 is not lined up with the retractable protrusion 1308. Additionally, J-slot ends 1314 may be provided that can turn the expandable portion 1304 so that the slats 1310 can be positioned to pass through either the slots 1312 or the slot 1314. Accordingly, in the exemplary embodiment with 6 retractable protrusions 1308, the J-slots 1314 can turn the expandable portion 1304 1/12th of a turn.

In accordance with an exemplary embodiment of the present invention utilizing the rotational hold down system of FIG. 13, the slats 1310 may be lined up with the retractable protrusions 1308 and pass through the slots 1314, extending the retractable protrusions 1308 into an extended position. With the retractable protrusions 1308 in the extended position, the expandable portion 1304 interfaces with the well bore wall or the casing and is rotationally locked in place as shown in FIG. 13*a*. Further, the drill pipe 140 which is rotationally coupled to the expandable portion 1308 through the slats 1310 is also rotationally locked in place, but can slide up or down through the slot 1314.

Figure 13C:
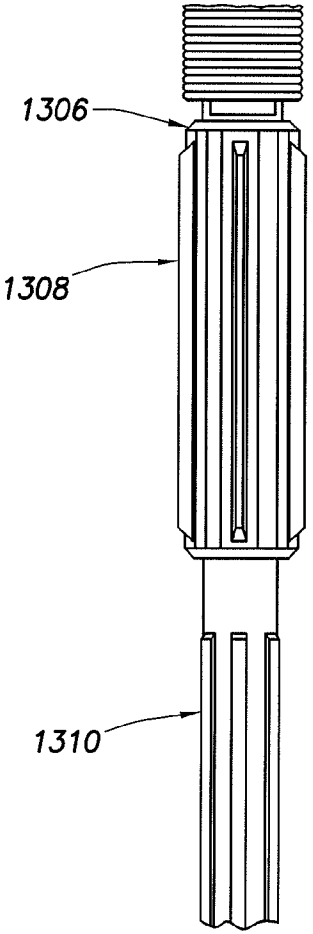

With the rotational hold down system controlling the rotation of the drill pipe 140, the drilling operations may begin. As shown in FIGS. 13*b* and 13*c*, as the drilling operations continue, the spring 1302 becomes compressed and the slats 1310 and the drill pipe 140 move downhole until the slats 1310 are disengaged from the slots 1314. Additionally, the J-slot 1316 has turned the expandable portion 1304 1/12th of a turn thereby aligning the slats with the slots 1312. With the slats 1310 in the slots 1312, the slats 1310 are not aligned with the retractable protrusions 1308 which remain retracted. Once the retractable protrusions 1308 are retracted, the spring 1302 will decompress pushing down the expandable portion 1304 as shown in FIG. 13*a*. The J-slot 1316 will then turn the expandable portion 1304 1/12th of the turn, aligning the slats 1310 with the slots 1314 and extending the retractable protrusions 1308. The process is then repeated until the well bore is drilled to desired depth.

As would be appreciated by those of ordinary skill in the art, with the benefit of this disclosure, the methods and systems disclosed herein are adaptable for drilling operations with bit rotation in either clockwise or counter clockwise direction. It would be appreciated by those of ordinary skill in the art, with the benefit of this disclosure, that the rotational hold down systems 500, 700 may be positioned at any desirable location along the drill string. For instance, in one exemplary embodiment, the rotational hold down system 500, 700 may be placed on the drillpipe 140. In another exemplary embodiment, the rotational hold down system 500, 700 may be placed on the optionally non-rotatable portion 208. In yet another embodiment, multiple rotational hold down systems 200, 500, 700 may be placed at different locations along the drill string in order to, for example, provide redundancy.

As would be apparent to those of ordinary skill in the art, a rotational hold down system provides smoother drilling operations (for example, by reducing bit jumping). Further, as would be appreciated by those of ordinary skill in the art, with the benefit of this disclosure, in certain embodiments a portion of the drill string located uphole relative to the rotational hold down system and/or the optionally non-rotatable portion of the drill string may include coiled tubing. In these exemplary embodiments, the rotational hold down system reduces the torsion fatigue on coiled tubing uphole.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A rotational hold down system for a drill string comprising:

an expandable portion, wherein the expandable portion is slidable along the drill string;

wherein the expandable portion comprises one or more protrusions, wherein the one or more protrusions are at least one of extendable from the expandable portion and retractable into the expandable portion;

wherein the expandable portion is operable to substantially prevent rotation of an optionally non-rotatable portion of the drill string, and a spring;

wherein the spring controls movement of the expandable portion along the drill string;

wherein at least one of extension of the one or more protrusions and retraction of the one or more protrusions is controlled by rotation of the expandable portion.

2. The system of claim 1, wherein a portion of the drill string located uphole relative to the rotational hold down system comprises coiled tubing.

3. The system of claim 1 further comprising:

a slat formed on the drill string;

a pair of slots formed on the expandable portion;

wherein the pair of slots is operable to engage the slat;

wherein the pair of slots comprises a first slot and a second slot;

wherein the first slot corresponds to one of the one or more protrusions and the second slot does not correspond to one of the one or more protrusions; and a J-slot end operable to rotate the expandable portion by a predetermined amount to selectively engage one of the first slot and the second slot with the slat.

4. The system of claim 3, wherein the rotational hold down system substantially prevents rotation of the drill string when the slat engages the first slot.

* * * * *